US011564289B2

(12) United States Patent
Linares

(10) Patent No.: US 11,564,289 B2
(45) **Date of Patent: *Jan. 24, 2023**

(54) MAGNETIC INDUCTION STYLE FURNACE OR HEAT PUMP WITH VARIABLE BLOWER FUNCTIONALITY INCLUDING RETRACTABLE MAGNET ARRAYS

(71) Applicant: Heat X, LLC, Auburn Hills, MI (US)

(72) Inventor: Miguel A. Linares, Bloomfield Hills, MI (US)

(73) Assignee: Heat X, LLC, Auburn Hills, MI (US)

( * ) Notice: Subject to any disclaimer, the term of this patent is extended or adjusted under 35 U.S.C. 154(b) by 372 days.

This patent is subject to a terminal disclaimer.

(21) Appl. No.: 16/671,379

(22) Filed: Nov. 1, 2019

(65) Prior Publication Data

US 2020/0068667 A1 Feb. 27, 2020

Related U.S. Application Data

(63) Continuation-in-part of application No. 16/519,437, filed on Jul. 23, 2019.
(Continued)

(51) Int. Cl.
*H05B 6/16* (2006.01)
*F24F 11/67* (2018.01)
*F24H 3/10* (2022.01)

(52) U.S. Cl.
CPC ..... *H05B 6/16* (2013.01); *F24F 11/67* (2018.01); *F24H 3/102* (2013.01)

(58) Field of Classification Search
CPC ..... H05B 6/109; H05B 6/108; H05B 6/06; H05B 6/102; H05B 6/16; H05B 6/22;
(Continued)

(56) References Cited

U.S. PATENT DOCUMENTS 2,448,010 A 8/1948 Baker et al.
2,489,939 A 11/1949 Traupel
(Continued)

FOREIGN PATENT DOCUMENTS

JP 2000110772 A 4/2000
WO 2006058404 A1 6/2006
(Continued)

OTHER PUBLICATIONS

International Search Report and Written Opinion for International Application No. PCT/US2019/045847; dated Nov. 28, 2019.

*Primary Examiner* — Tu B Hoang
*Assistant Examiner* — Vy T Nguyen
(74) *Attorney, Agent, or Firm* — Dinsmore & Shohl LLP

(57) ABSTRACT

A magnet/electromagnet thermal conditioning blower system including a housing having a fluid inlet. A sleeve shaped support extends within the housing, a plurality of spaced apart magnetic/electromagnetic plates being communicated with the inlet, such that the plates extend radially from said sleeve support. A conductive component is rotatably supported about the sleeve support, the conductive component incorporating a plurality of linearly spaced apart and radially projecting conductive plates which alternate with the axially spaced and radially supported magnetic plates. The magnetic/electromagnetic plates include radially telescoping stem and seat portions for displacing the plates between extended positions which radially overlap with the conductive plates during a thermally conditioning mode thermal in which high frequency oscillating magnetic fields are conducted to the rotating component for outputting as a thermally conditioning fluid flow and inwardly retracted positions relative to the conductive plates during a non-thermally conditioning blower mode.

8 Claims, 8 Drawing Sheets

Related U.S. Application Data

(60) Provisional application No. 62/757,328, filed on Nov. 8, 2018, provisional application No. 62/703,128, filed on Jul. 25, 2018.

(58) Field of Classification Search
CPC ..... F24H 3/102; F24D 2200/08; F24F 11/67; F24F 5/00; F25B 21/00; F25B 2321/0022; F25B 2321/0023; Y02B 30/00
USPC ..... 219/631, 628, 672, 513, 530, 540, 600, 219/630, 156, 601, 618, 629, 654, 670, 219/78.01; 165/129, 182, 55, 185; 415/169.1, 199.1, 199.2, 211.2, 58.2; 417/405, 423.9, 424.1; 310/195, 201, 310/211, 215, 216.118, 216.136, 261.1, 310/265, 422, 427, 431, 59; 123/2
See application file for complete search history.

(56) References Cited

U.S. PATENT DOCUMENTS

| | | | | |
|---|---|---|---|---|
| 3,014,116 | A | 12/1961 | MacArthur | |
| 4,512,289 | A | 4/1985 | Collins | |
| 5,334,819 | A | 8/1994 | Lin | |
| 5,914,065 | A * | 6/1999 | Alavi | H05B 6/108 219/630 |
| 6,297,484 | B1 * | 10/2001 | Usui | F24V 99/00 219/628 |
| 7,339,144 | B2 | 3/2008 | Lunneborg | |
| 7,420,144 | B2 | 9/2008 | Lunneborg | |
| 8,283,615 | B1 | 10/2012 | Albertson | |
| 8,373,103 | B2 * | 2/2013 | Waldner | F02M 31/042 392/397 |
| 8,418,832 | B1 * | 4/2013 | Albertson | F25B 15/00 219/628 |
| 8,616,016 | B2 * | 12/2013 | Asano | H02K 21/14 62/238.7 |
| 8,844,706 | B2 | 9/2014 | Albertson et al. | |
| 9,278,414 | B2 | 3/2016 | Haimer | |
| 9,544,945 | B2 | 1/2017 | Hadoulias et al. | |
| 9,631,252 | B2 | 4/2017 | Chatterjee et al. | |
| 9,883,552 | B2 * | 1/2018 | Nangle | H05B 6/108 |
| 10,425,998 | B2 * | 9/2019 | Nangle | H05B 6/109 |
| 2002/0070621 | A1 | 6/2002 | Mori et al. | |
| 2003/0066830 | A1 | 4/2003 | Reed et al. | |
| 2005/0039830 | A1 | 2/2005 | Christofis et al. | |
| 2005/0263522 | A1 * | 12/2005 | Lunneborg | H05B 6/108 219/672 |
| 2006/0086729 | A1 | 4/2006 | Lunneborg | |
| 2009/0223948 | A1 | 9/2009 | Hess | |
| 2011/0215089 | A1 | 9/2011 | Garza | |
| 2013/0062340 | A1 | 3/2013 | Hsu | |
| 2015/0001208 | A1 | 1/2015 | Albertson et al. | |
| 2017/0175770 | A1 * | 6/2017 | Waldner | F04D 17/08 |
| 2018/0094869 | A1 * | 4/2018 | Reshetnyak | F28F 9/001 |
| 2018/0176999 | A1 * | 6/2018 | Wilhelm Bavesteello | H05B 6/108 |

FOREIGN PATENT DOCUMENTS

| | | | |
|---|---|---|---|
| WO | 2014137232 | A1 | 9/2014 |
| WO | 2015074645 | A1 | 5/2015 |
| WO | 2019193122 | A1 | 10/2019 |

* cited by examiner

MAGNETIC INDUCTION STYLE FURNACE OR HEAT PUMP WITH VARIABLE BLOWER FUNCTIONALITY INCLUDING RETRACTABLE MAGNET ARRAYS

CROSS REFERENCE TO RELATED APPLICATIONS

The present application claims the priority of U.S. Ser. No. 62/757,328 filed Nov. 8, 2019. The present application is also a continuation in part of U.S. Ser. No. 16/519,437 filed Jul. 23, 2019 which claims the benefit of 62/703,128 filed Jul. 25, 2018.

FIELD OF THE INVENTION

The present invention relates generally to a magnetic or electromagnetic thermal conditioning (heating or cooling) assembly. More specifically, the present invention discloses a magnetic/electromagnetic heat generating furnace or heat pump which incorporates fixed or variable blower sub-assemblies, each of which includes a rotary heat convective plate, and such as integrated in multiple-tiered fashion within a drum-shaped component, and which is provided in combination with any number of proximally-spaced, length-alternating and circumferential magnet/electromagnet arrays. Rotation of the conductive plates relative to the magnet arrays results in the magnets/electromagnets generating a high-frequency oscillating magnetic field that causes the magnet/electromagnetic polarity to switch back and forth at a sufficient rate to produce friction, such conductively heating the surrounding airspace and proximately located inter-rotating conductive plates, and so that directing vanes incorporated into each of the rotating plates facilitate the generated heat being redirected out through an outlet of a surrounding cabinet housing associated with a furnace application. Without limitation, the magnetic heating assembly is reconfigurable into different operational modes to provide any of heating, pre-heating, blower, or magnetocaloric and heat pump enabling air conditioning functions.

BACKGROUND OF THE INVENTION

The concept of generating heat from magnets is generally known in the art and results from placing the magnetic material into a high-frequency oscillating magnetic field that causes the magnet's polarity to switch back and forth at a high-enough rate to produce noticeable friction which is given off in the form of heat. As is further known, such an oscillating field can result from rotating the magnets/electromagnets at speed relative to proximally-located metal conductive element.

Other prior art induction heater devices include an electronic oscillator which passes a high-frequency alternating current through an electromagnet in order to generate eddy currents flowing through the resistance of the material. In this fashion, the eddy currents result in a high-frequency oscillating magnetic field which causes the magnet's polarity to switch back and forth at a high-enough rate to produce heat as byproduct of friction.

One known example of a prior art induction heating system is taught by the electromagnetic induction air heater of Garza, US 2011/0215089, which includes a conductive element, a driver coupled to the conductive element, an induction element positioned close to the conductive element, and a power supply coupled to the induction element and the driver. Specifically, the driver applies an angular velocity to the rotate the conductive element about a rotational axis. The power supply provides electric current to the induction element to generate a magnetic field about the induction element such that the conductive element heats as it rotates within the magnetic field to transfer heat to warm the cold air flow streams. The cold air flow streams are circulated about the surface of the conductive element and directed by the moving conductive element to generate warm air flow streams from the conductive element.

Also referenced is the centrifugal magnetic heating device of Hsu 2013/0062340 which teaches a power receiving mechanism and a heat generator. The power receiving mechanism further includes a vane set and a transmission module. The heat generator connected with the transmission module further includes a centrifugal mechanism connected to the transmission module, a plurality of bases furnished on the centrifugal mechanism, a plurality of magnets furnished on the bases individually, and at least one conductive member corresponding in positions to the magnets. The vane set is driven by nature flows so as to drives the bases synchronically with the magnets through the transmission module, such that the magnets can rotate relative to the conductive member and thereby cause the conductive member to generate heat.

SUMMARY OF THE PRESENT APPLICATION

The present application discloses a magnet/electromagnet thermal conditioning blower system including a housing having a fluid inlet. A sleeve shaped support extends within the housing, a plurality of spaced apart magnetic/electromagnetic plates being communicated with the inlet, such that the plates extend radially from said sleeve support. A conductive component is rotatably supported about the sleeve support, the conductive component incorporating a plurality of linearly spaced apart and radially projecting conductive plates which alternate with the axially spaced and radially supported magnetic plates.

Upon rotating the conductive component relative to the magnetic/electromagnetic plates, thermal conditioning resulting from creation of high frequency oscillating magnetic fields being conducted to the rotating component for outputting as a thermally conditioned fluid flow through an outlet of the housing. The magnetic/electromagnetic plates each further including radially telescoping stem and seat portions for displacing the magnetic/electromagnetic plates between extended positions which radially overlap with the conductive plates during a thermally conditioning mode and inwardly retracted positions relative to the conductive plates during a non-thermally conditioning blower mode.

Additional features include each of the conductive plates exhibiting an array of channeling and redirecting vanes for influencing the thermally conditioned fluid flow through the outlet. A motor or input drive is provided for rotating at least one of the conductive component and the sleeve shaped support securing the magnetic/electromagnetic plates. A rotating drive shaft extends from the motor or input drive and secures to a coaxial mount location of the conductive component.

Other features include a slip ring structure secured to an interior location of the sleeve report and selectively engaging an extended location of the rotating drive shaft for concurrently driving the magnetic/electromagnetic plates with the conductive component. In a further variant, the first motor or input drive rotates the conductive component, with a second motor or input drive positioned at an opposite end rotating the sleeve shaped support securing the magnetic/electromagnetic plates.

Without limitation, the configuration and material selection for each of the conductive plates, conductive components or conductive elements are such that they can be selected from any conductive materials which can include varying patterns of materials, bi-materials or multi-materials designs, such including any of metals or alloys, ceramics or any metal ceramic composite materials with ferromagnetic, ferromagnetic, antiferromagnetic, paramagnetic or diamagnetic properties.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
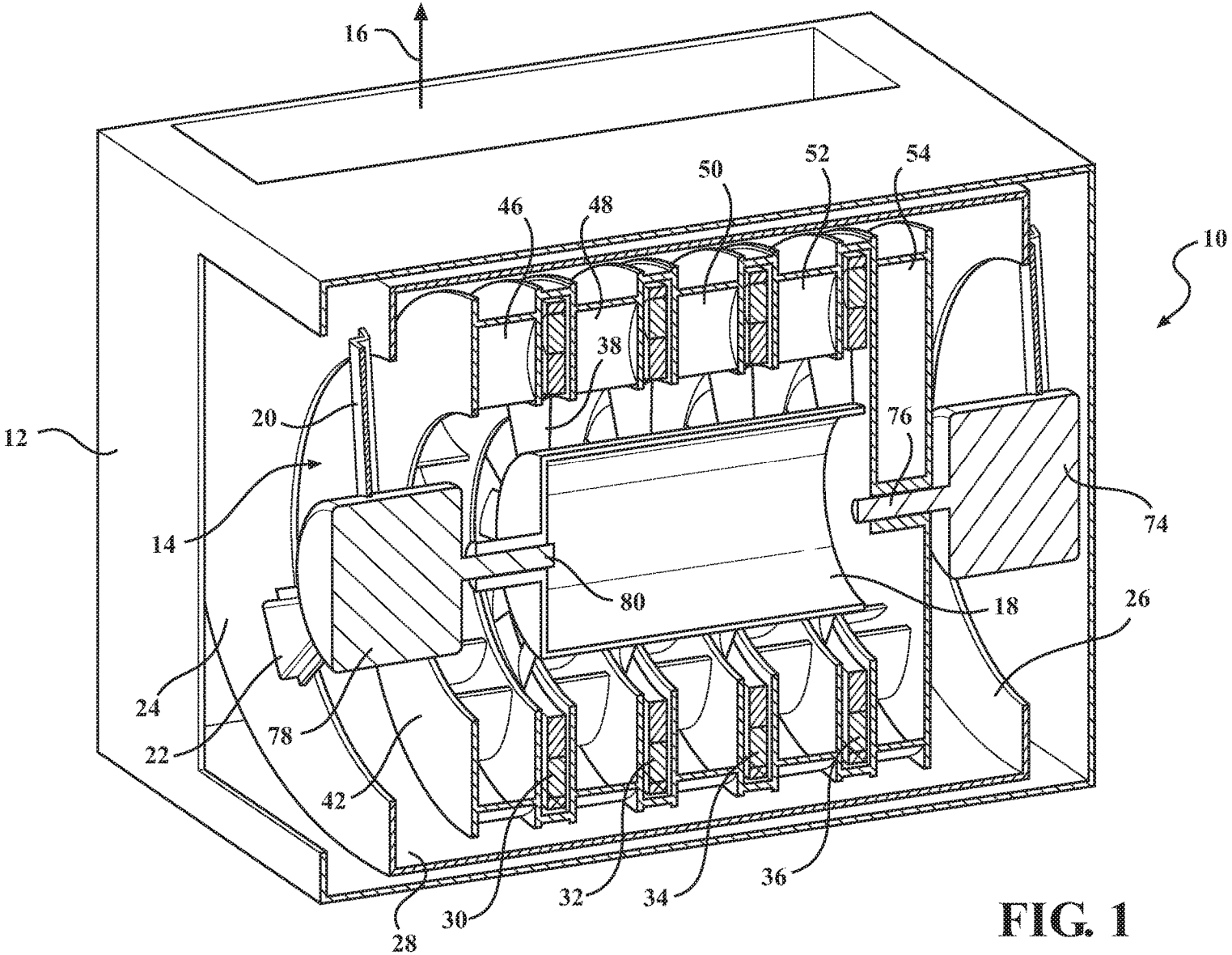
FIG. 1 is a perspective length cutaway of a magnetic heat generating furnace or magnetocaloric heat pump generating heat or cold according to a first embodiment and including a fixed axial extending sleeve with open interior channel and supporting a plurality of spaced magnetic or electromagnetic plates, an elongated conductive component rotatably supported about the sleeve, the conductive component incorporating a plurality of linearly spaced apart and radially projecting circular plates which alternate with the axially spaced and radially supported magnetic or electromagnetic plates such that, upon rotation the conductive plates, friction resulting from the oscillating magnetic fields of the magnets/electromagnets heat (under magnetization) or cold (under demagnetization) the surrounding air or fluid space via convection and are conducting into the rotating plates for eventual delivery through a thermally conditioning (e.g. heated/cooled) air or fluid outlet orifice of the furnace housing or cabinet, a pair of motors or input drives respectively driving the conductive component and magnetic/electromagnetic plates according to different cycling processes, including for use with a central air or fluid operation.
Figure 2:
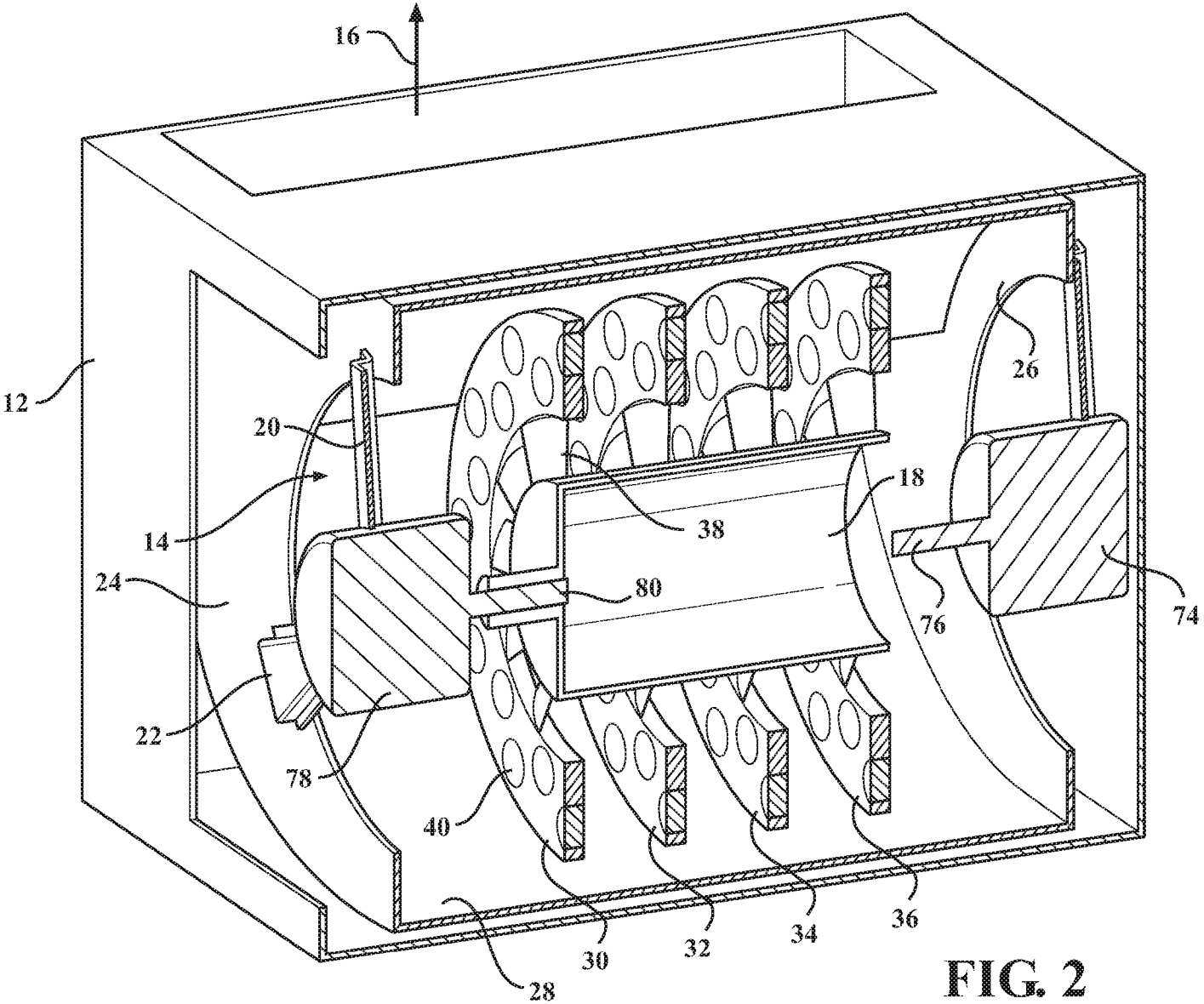
FIG. 2 is a further illustration in length cutaway of FIG. 1 in which the conductive component is removed in order to better illustrate the magnet/electromagnet plate arrays, the magnetic/electromagnetic plate motor or input drive and conductive component motor or input drive operating in varied modes including a first mode in which the magnetic/electromagnetic plate motor or input drive is locked while the blower/conductive element motor or input drive is running for normal heating/cooling, a second mode in which the magnetic/electromagnetic plate motor or input drive is run in a same direction as the blower motor or input drive during a non heating configuration in cooperation with an air or fluid conditioning cycle and, a third mode in which the magnetic/electromagnetic plate motor or input drive is run while the conductive element motor or input drive is locked to provide for preheat or precool of the air or fluid within the furnace cabinet, following which the magnetic/electromagnetic plates are fixed and the conductive component/plates are then rotated as in FIG. 1.
Figure 3:
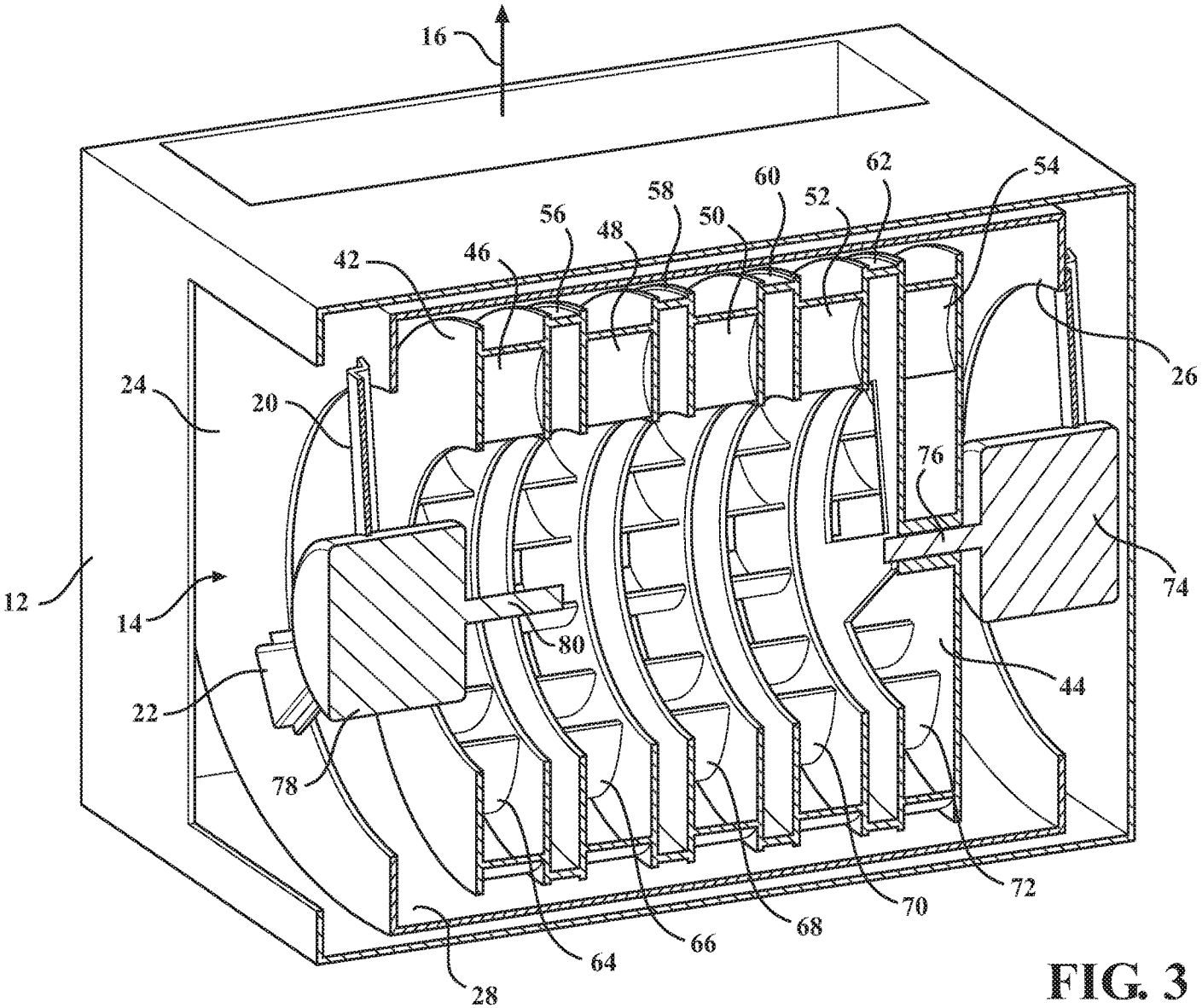
FIG. 3 is a further illustration similar to FIG. 2 in which the magnetic/electromagnetic plate array is removed for better showing the conductive component, and illustrating additional operational modes including the pair of motors or input drives being operated in opposite directions allowing the blower (conductive element) to function at operating RPM's, with the magnetic/electromagnetic plate motor or input drive increasing a flux conduction of the magnets/electromagnets to thereby increase a heat output.

With initial reference to FIGS. 1-3, the present invention discloses a magnet heat generating furnace, generally illustrated at 10, according to a first embodiment of the present invention. As will be further described with reference to the various embodiments, the magnetic heat generating assembly includes a variety of operational modes which enable any of heat, pre-heat, cold, pre-cool, blower, or air conditioning (AC compressor assist) cycles.

With initial reference to FIG. 1, depicted generally at 10 is a perspective length cutaway of a magnetic heat generating furnace according to a first embodiment having a three dimensional, typically rectangular, housing or cabinet 12 having a first side located fluid inlet 14 and a second top end located fluid outlet 16. An axial extending sleeve 18 (shown in FIGS. 1-2) is fixedly mounted in the variant of FIGS. 1-3 by brackets (see at 20 and 22) extending from the sleeve to outer mounting locations (see opposite end mounting plates 24 and 26 and outer cylindrical enclosure wall 28 which define a cylindrical interior chamber within the cabinet 12).

A plurality of spaced magnetic or electromagnetic plates 30, 32, 34 and 36 (see also FIG. 2) are depicted in one non-limiting arrangement arranged in axially spaced apart fashion and extending radially outwardly from the central sleeve 18 (the magnetic/electromagnetic plates can be solid or can include an outermost disk portion from which extend radial rib supports as further shown at 38 for selected plate 30). As also shown in FIG. 2, the magnetic/electromagnetic plates can each include either of an outer solid ring of magnetic material or, as shown, can include a plurality of individual magnetic/electromagnetic components (such as depicted at 40 for selected magnetic/electromagnet supporting plate 30).

An elongated conductive component (also partially depicted in cutaway) includes an elongated body rotatably supported about the sleeve 18 and between the magnetic/electromagnetic plates 30-36. The conductive component in one non-limiting depiction defines a further cylindrical chamber (see selected end walls 42 and 44) between which extends an outer connecting enclosure defining wall, also termed a second cylindrical wall, interconnecting each of a plurality of individual conductive plates (at 46, 48, 50, 52 and 54) arranged in alternating fashion with the magnetic plates 30, 32, 34, and 36.

FIG. 3 illustrates interconnecting locations, at 56, 58, 60 and 62 of the conductive component overlapping the exterior periphery of each magnetic plate 30-36, these maintaining the structural integrity of the cylindrical component during operation. Each of the individual cylindrical plates of the cylindrical rotating component also including pluralities of arcuate vanes (see also as depicted at 64, 66, 68, 70 and 72) which are arranged in circumferentially spatially arrayed fashion as shown. Without limitation, the vane configurations of the individual rotating conductive plates 46, 48, 50, 52 and 54 facilitate combined thermal conditioning and radial redirection of the fluid flow from the central inlet 14 for eventual distribution through the housing or cabinet outlet 16.

A first blower style motor or input drive 74 includes a drive shaft 76 which engages a central rotating location of the cylindrical conductive element (plates 46-54), with a second blower style motor or input drive 78 arranged at an opposite end of the cylindrical component and having an opposing extending drive shaft 80 which operates rotation of the central sleeve 18 and supported magnetic plate array 30-36. Upon rotation the conductive plates, friction resulting from the oscillating magnetic fields created by the relative rotation of the magnets/electromagnets result in the creation of a thermal conditioning (such as heat) in the zone (such as the airspace) surrounding the magnetic/electromagnetic plates, this being conducted into the rotating conductive plates for eventual delivery through a heated or other thermally conditioned air or fluid outlet orifice of the furnace cabinet.

As described, the magnetic plate motor or input drive 78 and conductive component motor or input drive 74 operate in varied modes, including a first mode in which the magnetic plate motor or input drive 74 is locked, while the blower/conductive element motor 74 is running for normal heating as described above. According to a second mode, the magnetic plate motor or input drive 78 is run in a same/common direction as the blower motor or input drive 74, during a no heating configuration, in which the lack of relative rotation between the magnetic plates the conductive element/plates results in no generation of heat. This results from the cooperating driving motors or input drives operating in combination with an air or fluid conditioning cycle including an externally located AC compressor pad (not shown), such that the furnace operates in a pure air or fluid movement/blower mode in order to move air or fluid through the furnace outlet 16.

A further third operational mode includes the magnetic plate motor or input drive 78 being run while the conductive element motor or input drive 74 is locked (so that the conductive element is stationary) in order to provide for preheat or pre-cool of the air or fluid within the furnace cabinet 12. Following this, the magnetic plates 30-36 are fixed (motor or input drive 78 deactivated) and the conductive component/plates (46-54) are then rotated as in FIG. 1.

FIG. 3 is a further illustration similar to FIG. 2, in which the magnetic plate array (30-36 in FIG. 2) is removed for better showing the conductive component, and illustrating additional operational modes including the pair of motors or input drives 74/78 being operated in opposite directions, allowing the blower (conductive element motor or input drive 74) to function at operating RPM's, with the magnetic/electromagnetic plate motor or input drive 78 increasing a flux conduction of the magnets/electromagnets (i.e. greater creation of frictional heat resulting from increased high frequency oscillating magnetic fields as compares to the normal heat mode in which the magnetic/electromagnetic plates are station, and to thereby increase the thermal conditioning, such as heat output, of the furnace). Without limitation, the motors or input drives 74/76 can be constructed of any of a synchronous or asynchronous variety and can be located either inside of or outside of the housing. 12

Figure 4:
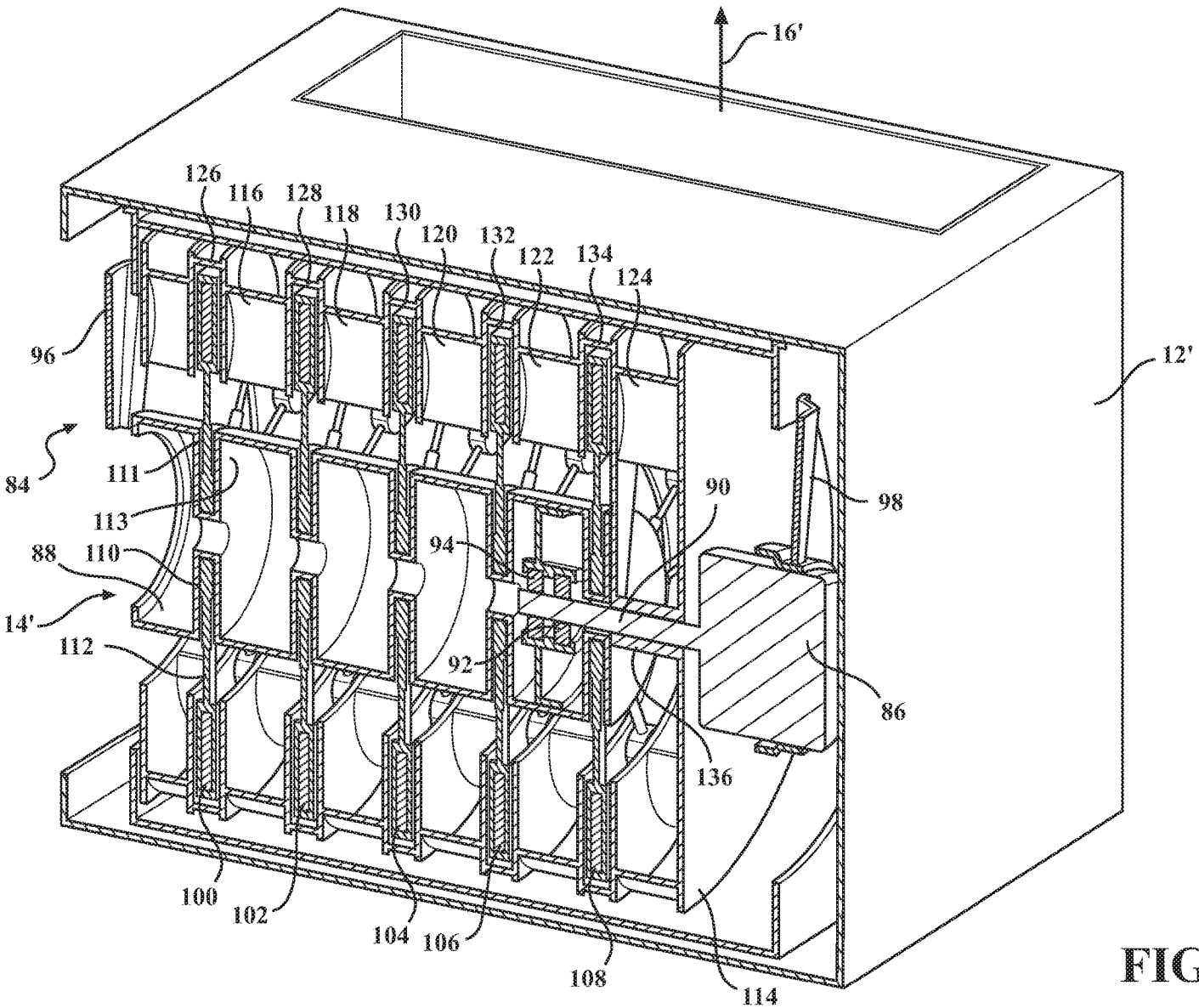
FIG. 4 is a length cutaway of a further variant of a magnetic heat generating furnace with a single operating motor or input drive configured for providing both heating and air or fluid conditioning modes and which includes a slip gear arrangement of optionally rotating the magnetic/electromagnetic plate arrays apart from the conductive element array, such as during a preheat cycle.

Proceeding to FIG. 4, a length cutaway is provided of a further variant of a magnetic or electromagnetic heat generating or other thermally conditioning furnace, generally shown at 84, with a single operating motor or input drive 86 configured for providing both heating and air or fluid conditioning modes. The furnace includes a cabinet or housing, at 12', similar to FIGS. 1-3 with each of a side directed fluid or air inlet 14' and an upper fluid or air directed outlet 16'. As shown in succeeding FIGS. 5-7, the furnace variant 84 includes many common features shown in the initial variant 10 of FIGS. 1-3, and which include an axial extending magnetic/electromagnetic plate support sleeve 88 which is secured to an extended end location of a drive shaft 90 extending from the motor or input drive 86, this via a slip ring engagement (at 92/94) which is mounted via a support bracket to an interior location of the central sleeve 88, and so that the sleeve and associated magnet/electromagnet arrays can be selectively rotationally engaged with or disengaged from the motor or input drive 86. The sleeve 88 is axially supported by additional structure (not shown) within the interior of the cabinet 12' and additional interior bracket supports 96/98 are provided similar to those depicted at 20/22 in FIG. 1, such as for supporting the motor or input drive 86 and the other interior structure of the magnetic/electromagnetic furnace assembly.

A plurality of spaced magnetic/electromagnetic plate arrays are shown at 100, 102, 104, 106 and 108 are depicted in one non-limiting arrangement arranged in axially spaced apart fashion and extending radially outwardly from the central sleeve 88. As further shown, the magnetic/electromagnetic plate arrays 100-108 include outer radial and plural circumferentially extending portions which are supported in a telescoping fashion provided by an inner radial sleeve or pocket (see at 110 for selected magnetic/electromagnetic plate array 100) which receives an inwardly radial extending stem portion (at 112) of selected magnetic plate array 100.

Additional drive componentry (not shown) is provided for converting the magnetic/electromagnetic arrays from an outwardly radially displaced position (FIGS. 4-5), thereby allowing inter-rotational magnetic/electromagnetic induced thermal conditioning (e.g. heating), and an inwardly radially retracted position depicted further at 100'-108' (FIGS. 6-7) in which the individual pluralities of magnetic/electromagnetic arrays are withdrawn from an overlapping position with the alternating conductive plates, thereby preventing the magnetic/electromagnetic thermal conditioning (e.g.

generation of heat). Each of the individually plurality of circumferentially arrayed and inner radial extending sleeves or pockets 110 associated with each magnetic/electromagnetic array is in turn supported within a disk package depicted by axially spaced walls, see at 111 and 113 for selected array 100, for structurally supporting the individual pluralities of magnetic/electromagnetic arrays between the extended position of FIGS. 4-5 and the retracted positions of FIGS. 6-7.

The elongated conductive component (also partially depicted in cutaway) again includes an elongated body rotatably supported about the sleeve 88 and between the magnetic/electromagnetic plate arrays 100-108. The conductive component defines a further cylindrical chamber (see selected end wall 114 in FIG. 4) between which extends an outer connecting enclosure defining wall, also termed a second cylindrical wall, interconnecting each of a plurality of individual conductive plates (at 116, 118, 120, 122 and 124) arranged in alternating fashion with the magnetic/electromagnetic plate arrays 100, 102, 104, 106 and 108.

Figure 7:
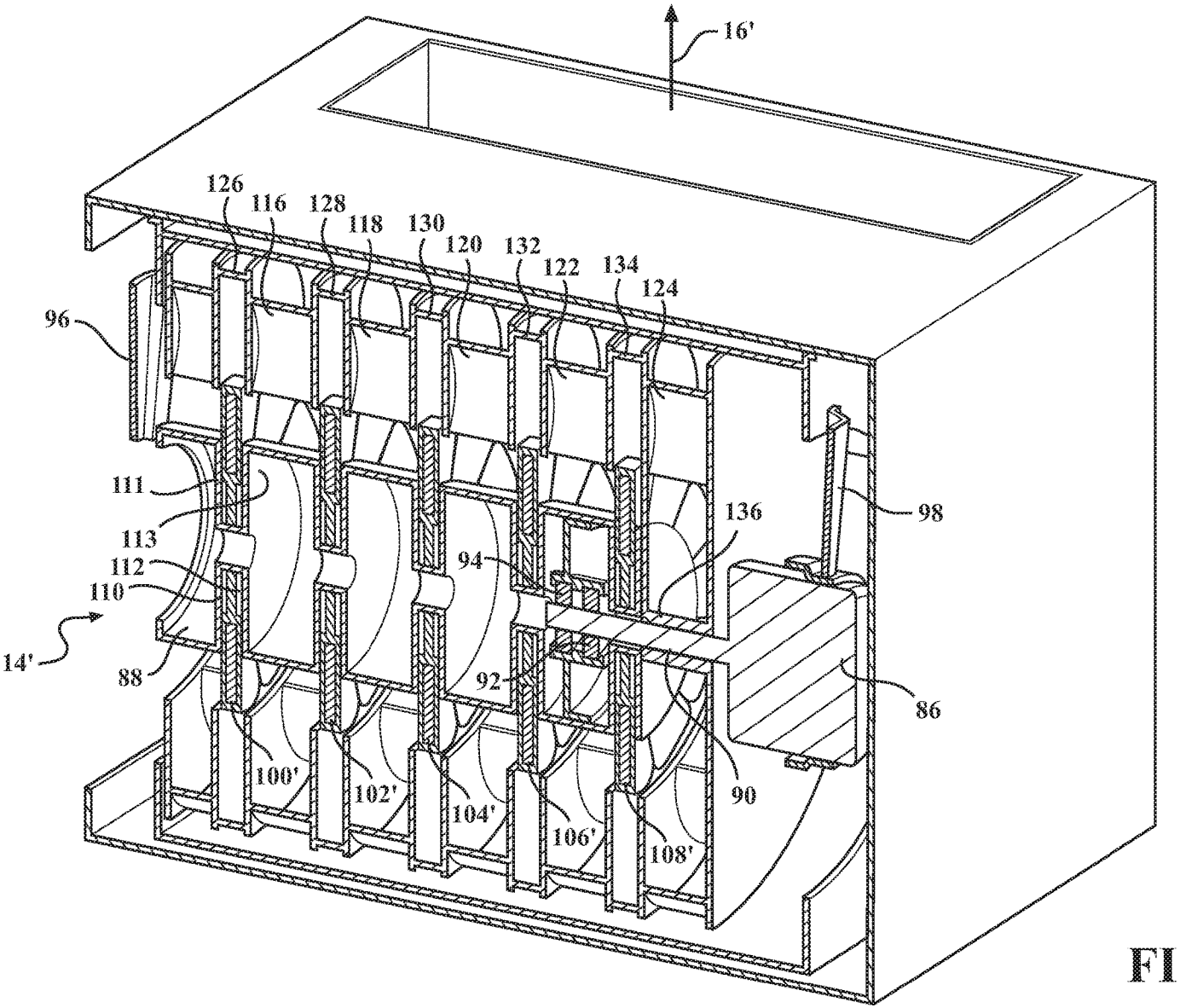
FIG. 7 is a similar illustration to FIG. 6 illustrating the conductive element in combination with the retracted magnet/electromagnet plate arrays in a neutral/blower operating mode (the conductive element operating in a purely air or fluid flow redirection mode in which no flux conduction resulting from oscillating magnetic fields occurs) to provide either of non-thermally conditioning air or fluid flow as well as air or fluid conditioning cooling air or fluid flow.

Further illustrated in FIG. 7 are interconnecting locations, at 126, 128, 130, 132 and 134, of the conductive component overlapping the exterior periphery of each magnetic/electromagnetic plate array 100-108, these maintaining the structural integrity of the cylindrical component during operation. Each of the individual cylindrical plates of the cylindrical rotating component also include pluralities of circumferential arcuate vanes (not shown in these views but similar to those depicted previously at 64, 66, 68, 70 and 72 in FIG. 3), and for centrally admitting and outwardly radially redirecting the fluid flow during thermal conditioning thereof prior to its being distributed through outlet 16'. Also shown at 136 in selected FIGS. 4 and 7 is a selected axial end mounting location associated with the conductive component for rotatably supporting the same to the motor or input drive 86.

Figure 5:
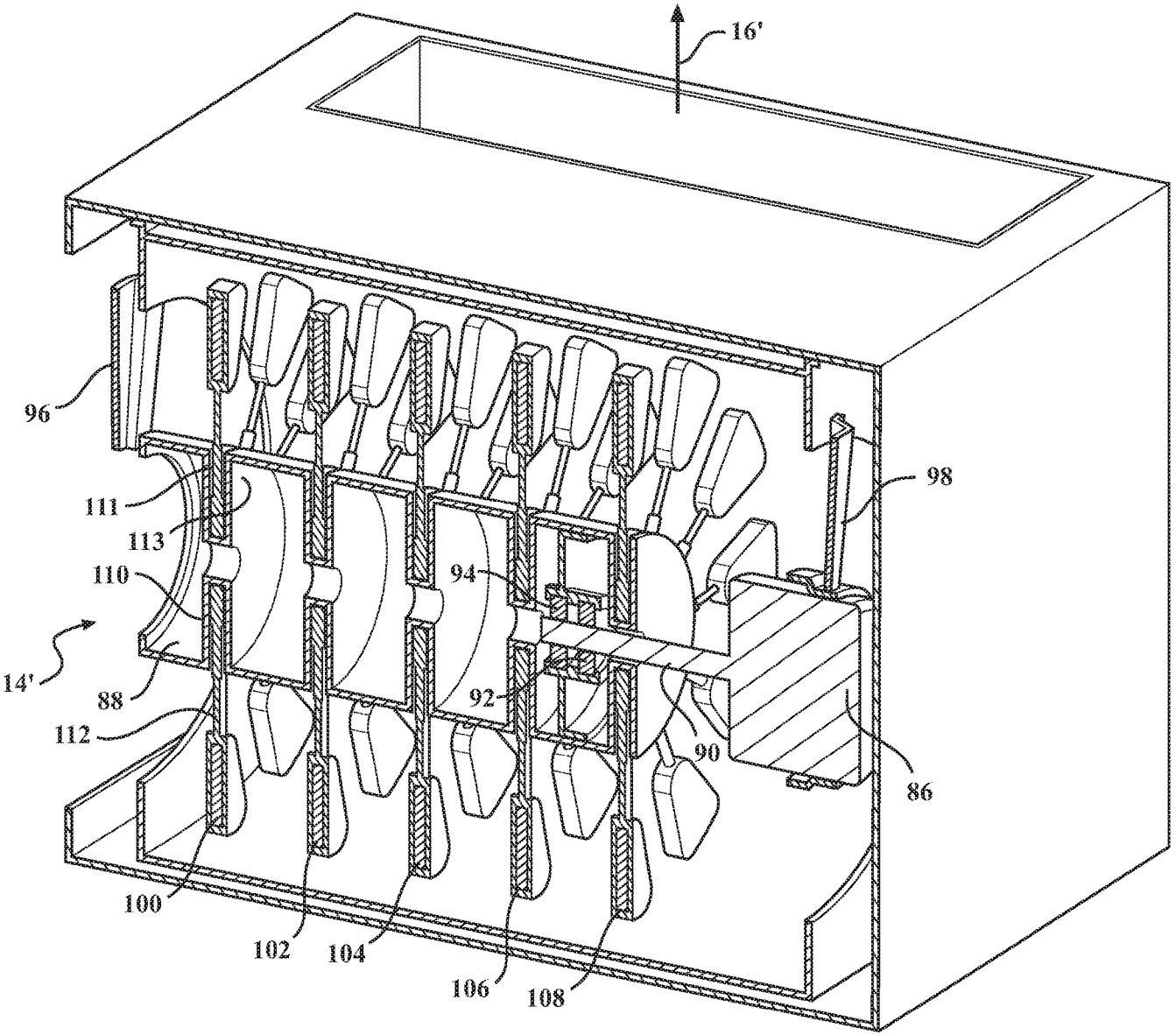
FIG. 5 is an illustration similar to FIG. 4 with the conductive element removed for better illustrating the optionally rotatable and retractable magnet/electromagnet plate arrays.

In operation, FIGS. 4-5 operate similar to the initial mode of previously described FIGS. 1-3 in which the slip ring engagement structure 92/94 is selectively activated or deactivated to either rotate the magnetic/electromagnetic arrays 100-108 in unison with the conductive component (plates 116-124) in a temperature neutral (non-heating) blower mode (such as in use with an AC compressor operation) or to render the magnetic/electromagnetic arrays stationary in a standard magnetic/electromagnetic heating operation in which individual conductive plates of the cylindrical conductive element rotate relative to the magnetic/electromagnetic arrays in order to generate magnetic/electromagnetic induced heat in the manner previously described.

Figure 6:
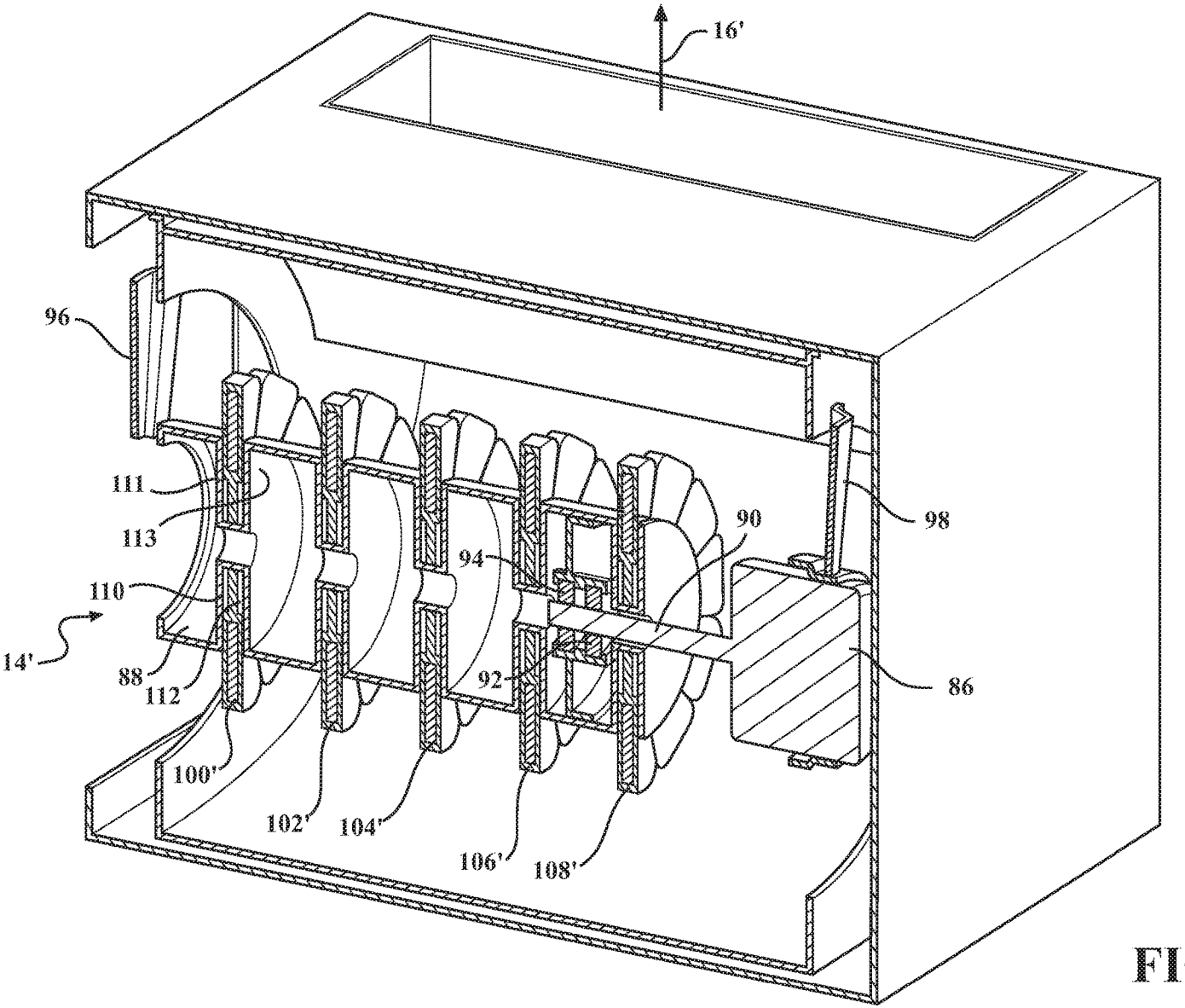
FIG. 6 is a succeeding illustration to FIG. 5 illustrating the magnetic/electromagnetic plates in a retracted configuration so as to be disposed radially inwardly from the opposing plates of the conductive element, the conductive element rotating in a temperature neutral blower assist mode in cooperation with an external air or fluid conditioning operation.

Proceeding to FIG. 6, a succeeding illustration to FIG. 5 illustrates the individual pluralities of the magnetic plate arrays 100'-108' again in their retracted configuration so as to be disposed radially inwardly from the opposing plates 116-124 of the overall cylindrical shaped and rotatable conductive element, the conductive element rotating in a temperature neutral blower assist mode in cooperation such as again with an external air or fluid conditioning operation. FIG. 7 again provides a similar illustration to FIG. 6, showing the conductive element in combination with the retracted magnet/electromagnet plate arrays in a neutral/blower operating mode (the conductive element operating in a purely air or fluid flow redirection mode in which no flux conduction results from oscillating magnetic fields occurs) and to provide either of an ambient or air/fluid conditioning cooling air or fluid flow.

Figure 8:
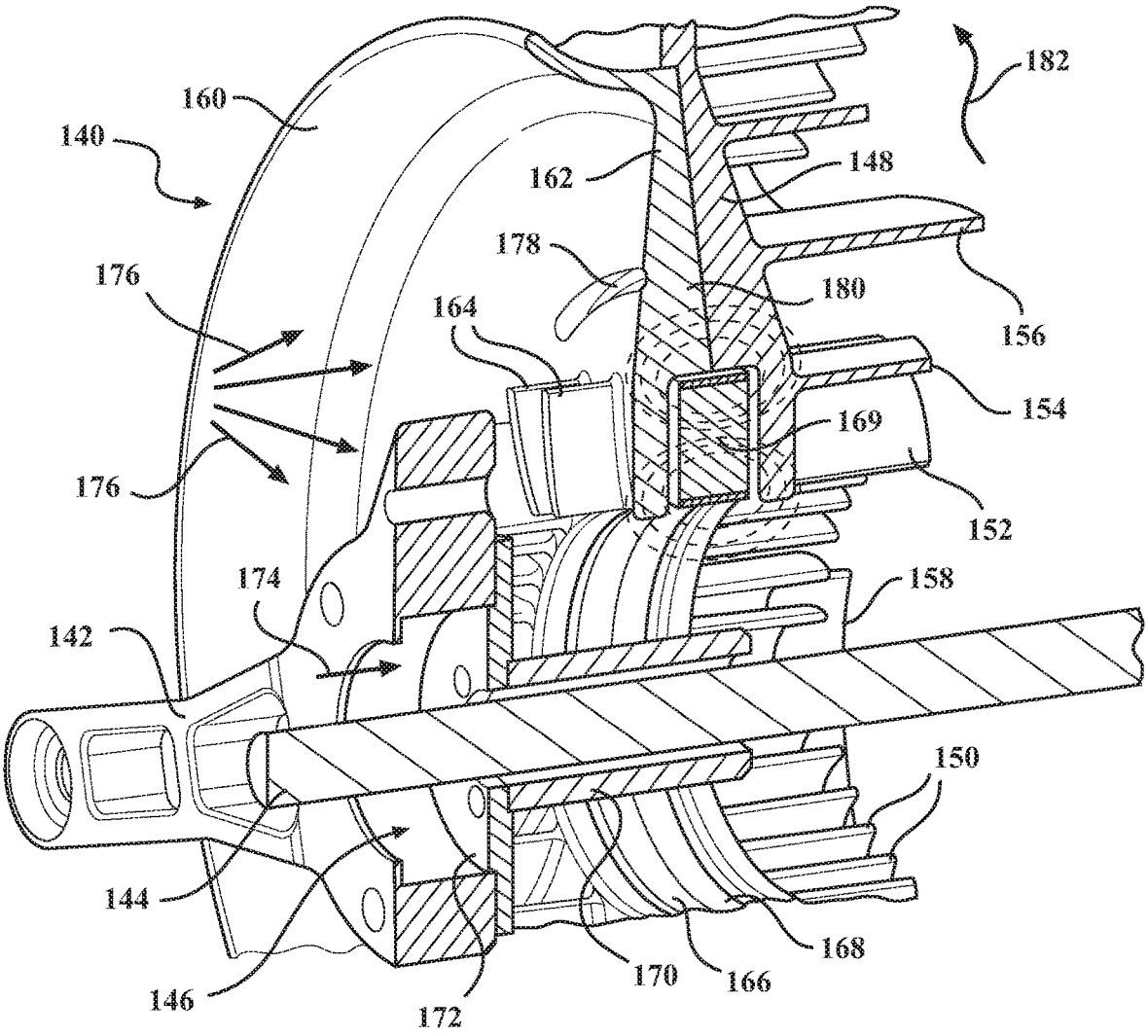
FIG. 8 is an illustration of a blower style magnetic/electromagnet heater or cooler assembly according to a related variant of the present invention for generating opposite directed magnetic fields by the stationary mounted magnetic/electromagnetic plates, thereby multiplying the conductive heating or cooling profile which is created.

Finally, and proceeding to FIG. 8 a detached perspective is generally shown at 140 of a selected magnet/electromagnet heat/thermal conditioning blower subassembly according to a related variant of the present invention. The magnet/electromagnet blower assembly can be designed to be integrated into any suitable cabinet configuration and/or can be provided as a stand-alone housing which is integrated into any magnet/electromagnet heat generating operation, such as singularly or in plural series or parallel fashion.

A multi-blade intake fan (not shown) can be positioned within an opening of an associated housing of the blower assembly. Partially illustrated at 142 is a support bracket which is secured, such as with fasteners, at distal end locations to the associated housing (not shown in this view) and so that a shaft 144 (such as which is powered by a separate motor or other rotating input drive) is supported within a central width extending location 146 through an interior of the blower housing.

A drum shaped combination conductive and air or fluid redirecting component is partially shown at 148 and is rotatably supported to the central rotating shaft 146 via a central coaxial mounting structure (not shown). The rotatable drum component 148 can be constructed of a suitable conductive material and includes inner and outer radially disposed and circumferentially extending air or fluid flow directing vanes, the outer radial positioned and arcuate shaped pattern of air or fluid flow redirecting vanes being shown at 150 and the inner radial pattern of vanes further shown at 152. An intermediate array of spiraling and redirection locations 154, 156 and 158 are also shown for assisting in redirecting an axial inlet air or fluid flow (such as through the side disposed fan blade) in a subsequent and radially outwardly redirected fashion in which the magnetic/electromagnetic heating or cooling of the conductive element results in a heated or cooled air or fluid flow redirected outwardly by the arrangement of vanes 152/154 and spiral redirecting and air or fluid flow baffling portions 154, 156 and 158.

A shroud 160 surrounds the air or fluid inlet location (such as supporting an interiorly rotating fan element or other structure) and includes a base wall 162 secured to the main wall thickness again at 148 of the conductive component. The shroud 160 further includes additional inner radial and circumferentially arrayed vanes 164, such as located between an inside of a mounted fan blade arrangement, and the radial surface of the shroud to further assist in redirection of air or fluid flow across the magnet/electromagnet arrays and eventually circumferentially outward through the blower exit.

Magnet or electromagnet arrays are shown at 166 and 168 and are secured, via an interior sleeve 170 coaxially surrounding the interiorly rotating shaft 144, to an end flange 172 anchored to the end support bracket 142. Although not shown, the shaft 144 is further supported within the open interior 146 of the support bracket via a bearing support array (not shown). The magnet incorporated into each of the arrays can further include a solid or segmented plurality of individual magnets (see at shown at 169).

In operation, the rotation of the conductive drum element 148, shroud 162 and fan cause an intake air or fluid flow to be communicated by the fan in directions 174 across a middle interior of the magnet/electromagnet arrays 166/168. Additional outer radial inlet air or fluid flows 176 are directed toward smaller sized cooling vents 178 within the support shroud 160, which facilitate the passage of additional air or fluid flows in and around the magnet/electromagnet plate arrays.

The thickness of the side wall 148 of the drum, as well as that of the adjoining wall location 162 of the shroud 160 is further shown greatest proximate the magnetic/electromagnetic plate arrays 166/168 for accomplishing maximum thermal conditioning (e.g. heat transfer) to the conductive component. In this fashion, the oscillating magnetic fields resulting from the rotation of the conductive and air or fluid flow redirecting element 148 (see in phantom at 180) maximize the heat conductivity generated from the magnet/electromagnet arrays which heats the conductive component and which is then convected to the proximal air or fluid flow patterns generated from the intake in a radially outwardly directed fashion (see arrow 182) progressively as guided by the inner radial vanes 152, the spiraling baffle elements 154-158 and the outermost radial located vanes 150 extending from the conductive rotating element according to a plural and circumferential array. The arrangement of the vanes and baffling elements further assist in slowing down the radial outward air or fluid flow in order to maximize heat transfer from the conductive rotating element to the surrounding air or fluid flow, such as which is maximized at the super thermal conditioning (or super heating) locations associated with the arrangement of the magnets/electromagnets.

As previously described, other and additional envisioned applications can include adapting the present technology for use in magnetocaloric heat pump (MHG) applications, such utilizing a magneto-caloric effect (MCE) provide either of heating or cooling properties resulting from the magnetization (heat) or demagnetization (cold) cycles. The goal in such applications is to achieve a coefficient of performance (defined as a ratio of useful heating or cooling provided to work required) which is greater than 1.0. In such an application, the system operates to convert work to heat as well as additionally pumping heat from a heat source to where the heat is required (and factoring in all power consuming auxiliaries). As is further known in the relevant technical art, increasing the COP (such as potentially to a range of 2.0-3.5 or upwards) further results in significantly reduced operating costs in relation to the relatively small input electrical cost required for rotating the conductive plate(s) relative to the magnetic plate(s). Magnetic refrigeration techniques result in a cooling technology based on the magneto-caloric effect and which can be used to attain extremely low temperatures within ranges used in common refrigerators, such as without limitation in order to reconfigure the present system as a fluid chiller, air or fluid cooler, active magnetic regenerator or air conditioner.

As is further known in the relevant technical art, the magneto-caloric effect is a magneto-thermodynamic phenomenon in which a temperature change of a suitable material is again caused by exposing the material to a changing magnetic field, such being further known by low temperature physicists as adiabatic (defined as occurring without gain or loss of heat) demagnetization. In that part of the refrigeration process, a decrease in the strength of an externally applied magnetic field allows the magnetic domains of a magneto-caloric material to become disoriented from the magnetic field by the agitating action of the thermal energy (phonons) present in the material.

If the material is isolated so that no energy is allowed to (re)migrate into the material during this time, (i.e., again the adiabatic process) the temperature drops as the domains absorb the thermal energy to perform their reorientation. The randomization of the domains occurs in a similar fashion to the randomization at the curie temperature of a ferromagnetic, ferrimagnetic, antiferromagnetic, paramagnetic or diamagnetic material, except that magnetic dipoles overcome a decreasing external magnetic field while energy remains constant, instead of magnetic domains being disrupted from internal ferromagnetism, ferrimagnetism, antiferromagnetism, (or either of paramagnetism/diamagnetism) as energy is added. Applications of this technology can include, in one non-limited application, the ability to heat a suitable alloy arranged inside of a magnetic field as is known in the relevant technical art, causing it to lose thermal energy to the surrounding environment which then exits the field cooler than when it entered.

Other envisioned applications include the ability to generate heat/cold for conditioning any fluid (not limited to water) utilizing either individually or in combination rare earth magnets placed into a high frequency oscillating magnetic field as well as static electromagnetic field source systems including such as energized electromagnet assemblies which, in specific instances, can be combined together within a suitable assembly not limited to that described and illustrated herein and for any type of electric induction, electromagnetic and magnetic induction application. It is further envisioned that the present assembly can be applied to any material which is magnetized, such including any of diamagnetic, paramagnetic, and ferromagnetic, ferrimagnetic or antiferromagnetic materials without exemption also referred to as magnetocaloric materials (MEMs).

Additional factors include the ability to reconfigure the assembly so that the frictionally heated or cooled fluid existing between the overlapping rotating magnetic and stationary fluid communicating conductive plates may also include the provision of additional fluid mediums (both gaseous and liquid state) for better converting the heat or cooling configurations disclosed herein. Other envisioned applications can include the provision of capacitive and resistance (ohmic power loss) designs applicable to all materials/different configurations as disclosed herein.

The present invention also envisions, in addition to the assembly as shown and described, the provision of any suitable programmable or software support mechanism, such as including a variety of operational modes. Such can include an Energy Efficiency Mode: step threshold function at highest COP (at establish motor or input drive rpm) vs Progressive Control Mode: ramp-up curve at different rpm/COPs).

Other heat/cooling adjustment variables can involve modifying the degree of magnetic friction created, such as by varying the distance between the conductive fluid circulating disk packages and alternating arranged magnetic/electromagnetic plates. A further variable can include limiting the exposure of the conductive fluid (gas, liquid, etc.,) to the conductive component/linearly spaced disk packages, such that a no flow condition may result in raising the temperature (and which can be controllable for certain periods of time).

As is further generally understood in the technical art, temperature is limited to Curie temperature, with magnetic properties associated with losses above this temperature. Accordingly, rare earth magnets, including such as neodymium magnets, can achieve temperature ranges upwards of 900° C. to 1000° C.

Ferromagnetic, ferrimagnetic, antiferromagnetic, paramagnetic or diamagnetic materials, such as again which can be integrated into the conductive plates, can include any of Iron (Fe) having a Curie temperature of 1043° K (degrees Kelvin), Cobalt (Co) having a Curie temperature of 1400° K, Nickel (Ni) having a Curie temperatures of 627° K and Gadolinium (Gd) having a Curie temperature of 292° K.

According to these teachings, Curie point, also called Curie Temperature, defines a temperature at which certain magnetic materials undergo a sharp change in their magnetic properties. In the case of rocks and minerals, remanent magnetism appears below the Curie point—about 570° C. (1,060° F.) for the common magnetic mineral magnetite. Below the Curie point—by non-limiting example, 770° C. (1,418° F.) for iron—atoms that behave as tiny magnets spontaneously align themselves in certain magnetic materials.

In ferromagnetic materials, such as pure iron, the atomic magnets are oriented within each microscopic region (domain) in the same direction, so that their magnetic fields reinforce each other. In antiferromagnetic materials, atomic magnets alternate in opposite directions, so that their magnetic fields cancel each other. In ferrimagnetic materials, the spontaneous arrangement is a combination of both patterns, usually involving two different magnetic atoms, so that only partial reinforcement of magnetic fields occurs.

Given the above, raising the temperature to the Curie point for any of the materials in these three classes entirely disrupts the various spontaneous arrangements, and only a weak kind of more general magnetic behavior, called paramagnetism, remains. As is further known, one of the highest Curie points is 1,121° C. (2,050° F.) for cobalt. Temperature increases above the Curie point produce roughly similar patterns of decreasing paramagnetism in all three classes of materials such that, when these materials are cooled below their Curie points, magnetic atoms spontaneously realign so that the ferromagnetism, antiferromagnetism, or ferrimagnetism revives. As is further known, the antiferromagnetic Curie point is also referenced as the Néel temperature.

Other factors or variable controlling the temperature output can include the strength of the magnets/electromagnets which are incorporated into the plates, such as again by selected rare earth magnets having varying properties or, alternatively, by adjusting the factors associated with the use of electromagnets including an amount of current through the coils, adjusting the core ferromagnetic properties (again though material selection) or by adjusting the cold winding density around the associated core.

Other temperature adjustment variables can include modifying the size, number, location and orientation of the assemblies (elongated and plural magnet/electromagnet and alternative conductive plates). Multiple units or assemblies can also be stacked, tiered or otherwise ganged in order to multiply a given volume of conditioned fluid which is produced.

Additional variables can include varying the designing of the conductive disk packages, such as not limited varying a thickness, positioning or configuration of a blade or other fluid flow redirecting profile integrated into the conductive plates, as well as utilizing the varying material properties associated with different metals or alloys, such including ferromagnetic, ferrimagnetic, antiferromagnetic, paramagnetic and diamagnetic properties.

Having described my invention, other and additional preferred embodiments will become apparent to those skilled in the art to which it pertains, and without deviating from the scope of the appended claims. The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

I claim:

1. A magnet/electromagnet thermal conditioning blower system, comprising:

a housing having a fluid inlet;

a multi-blade intake fan positioned within an opening of said housing defining said fluid inlet;

a shaft extending within said housing and supporting a combination rotatable drum shaped conductive and fluid redirecting component;

a shroud anchored to a side wall of said combination rotatable drum shaped conductive and fluid redirecting component, a plurality of radial and circumferentially arrayed vanes extending from said shroud opposing said multi-blade intake fan;

at least one plurality of air or fluid flow redirecting vanes configured in said combination rotatable drum shaped conductive and fluid redirecting component, at least one magnet or electromagnetic array secured, via an interior sleeve coaxially surrounding said rotating shaft, to an end flange anchored to an end support bracket, said at least one magnet/electromagnet array further including any of a solid or segmented plurality of individual magnet or electromagnetic plates arranged between said shroud and said combination rotatable drum shaped conductive and fluid redirecting component in communication with said fluid inlet;

upon said shaft rotating said combination rotatable drum shaped conductive and fluid redirecting component and said shroud relative to said at least one magnetic/electromagnetic array, thermal conditioning resulting from creation of high frequency oscillating magnetic fields and being conducted radially outwardly through said rotating combination rotatable drum shaped conductive and fluid redirecting component for outputting as a thermally conditioning fluid flow through an outlet of said housing.

2. The invention as described in claim 1, further comprising a thickness of the side wall of said combination rotatable drum shaped conductive and fluid redirecting component and an adjoining wall location of said shroud progressively increasing in an inner radial direction and being greatest proximate said solid or segmented plurality of individual magnetic/electromagnetic plates.

3. The invention as described in claim 1, said at least one plurality of said air or fluid flow redirecting vanes further comprising a first inner plurality of circumferentially arrayed vanes and a second outer plurality of circumferentially arrayed vanes.

4. The invention as described in claim 3, further comprising air or fluid regulating baffles located between said first inner plurality of circumferentially arrayed vanes and said second outer plurality of circumferentially arrayed vanes to facilitate a continuous and interrupted movement of air or fluid flow within said combination rotatable drum shaped conductive and fluid redirecting component and through the outlet.

5. The invention as described in claim 1, said combination rotatable drum shaped conductive and fluid redirecting component further comprising an intermediate array of spiraling and redirection locations for assisting in redirecting the fluid flow.

6. The invention as described in claim 1, said combination rotatable drum shaped conductive and fluid redirecting component further comprising spiral redirecting and air or fluid flow baffling portions.

7. The invention of claim 1, further comprising a motor or input drive for rotating said shaft, said motor or input drive being of either of a synchronous or asynchronous variety.

8. The invention of claim 1, further comprising a motor or input drive for rotating said shaft and being located inside or outside of said housing.

* * * * *